US011123759B2

(12) United States Patent
Elmeguenni

(10) Patent No.: US 11,123,759 B2
(45) Date of Patent: Sep. 21, 2021

(54) PRODUCT DISPENSING SYSTEM FOR A BOTTLE

(71) Applicant: ALBEA LE TREPORT, Le Treport (FR)

(72) Inventor: Mohamed Elmeguenni, Friville Escarbotin (FR)

(73) Assignee: ALBEA LE TREPORT, Le Treport (FR)

( * ) Notice: Subject to any disclaimer, the term of this patent is extended or adjusted under 35 U.S.C. 154(b) by 0 days.

(21) Appl. No.: 15/442,756

(22) Filed: Feb. 27, 2017

(65) Prior Publication Data

US 2017/0246649 A1 Aug. 31, 2017

(30) Foreign Application Priority Data

Feb. 29, 2016 (FR) ..... 1651678

(51) Int. Cl.

| | |
|---|---|
| ***B05B 11/00*** | (2006.01) |
| ***B05B 15/30*** | (2018.01) |
| ***A45D 34/00*** | (2006.01) |
| *B65D 83/38* | (2006.01) |

(52) U.S. Cl.

CPC ..... *B05B 11/3047* (2013.01); *A45D 34/00* (2013.01); *B05B 11/0008* (2013.01); *B05B 11/3043* (2013.01); *B05B 15/30* (2018.02); *A45D 2034/007* (2013.01); *B65D 83/38* (2013.01)

(58) Field of Classification Search

CPC ..... A45D 34/00; A45D 2034/007; B05B 11/3047; B05B 11/3043; B05B 11/0008; B05B 15/005; B05B 11/305; B65D 83/38

See application file for complete search history.

(56) References Cited

U.S. PATENT DOCUMENTS 4,671,432 A * 6/1987 Benecke ..... B67D 7/0205 222/256
4,832,236 A * 5/1989 Greaves ..... B65D 83/38 222/402.1
5,083,685 A * 1/1992 Amemiya ..... B65D 83/38 222/402.1
5,827,247 A * 10/1998 Kay ..... A61F 5/451 604/327

(Continued)

FOREIGN PATENT DOCUMENTS

FR 2762762 A1 11/1998
FR 2769678 A1 4/1999

(Continued)

OTHER PUBLICATIONS

Norbert Willenbacher and Olga V. Lebedeva University of Karlsruhe Jul. 24, 2008 see p. 1.*
French Application 1651678, Search Report, dated Nov. 2, 2016.

*Primary Examiner* — Vishal Pancholi
*Assistant Examiner* — Bob Zadeh
(74) *Attorney, Agent, or Firm* — Banner & Witcoff, Ltd.

(57) ABSTRACT

A dispensing system (5) is suitable for being fastened on a bottle (1). The system has parts facing one another having surfaces facing one another and has a material allowing at least part of at least one of the surfaces facing one another to have an adhesive effect for attaching the facing parts. A bottle (1) utilizes the dispensing system (5).

16 Claims, 2 Drawing Sheets

(56) References Cited

U.S. PATENT DOCUMENTS 6,096,376 A * 8/2000 Yamamoto ..... B05B 13/0654 118/308
6,158,629 A * 12/2000 Abplanalp ..... B65D 83/38 222/402.1
6,398,077 B1 * 6/2002 Gross ..... B65D 47/2031 222/145.1
6,415,962 B1 * 7/2002 Bougamont ..... B05B 11/0043 222/321.7
7,503,466 B2 * 3/2009 Ramet ..... B05B 11/0059 222/321.9
8,616,417 B2 * 12/2013 Neuhaus ..... B65D 47/2031 222/402.13
9,642,998 B2 * 5/2017 Nordsiek ..... A61K 9/0014
2001/0009720 A1 * 7/2001 Nagata ..... B29C 45/14311 428/411.1
2002/0041054 A1 * 4/2002 Leicht ..... F16J 15/108 264/255
2003/0123919 A1 * 7/2003 Gueret ..... A45D 34/00 401/130
2004/0127614 A1 * 7/2004 Jiang ..... C08F 10/00 524/270
2004/0134824 A1 * 7/2004 Chan ..... B65D 83/38 206/524.1
2004/0161560 A1 * 8/2004 Baranowski ..... B65D 41/34 428/35.7
2005/0263480 A1 * 12/2005 Smolko ..... A45F 3/20 215/308
2005/0274454 A1 * 12/2005 Extrand ..... C09J 5/00 156/272.4
2005/0279774 A1 * 12/2005 Kuwahara ..... B05B 11/3025 222/383.1
2006/0081655 A1 * 4/2006 Beranger ..... B05B 11/3049 222/321.9
2007/0241132 A1 * 10/2007 Smith ..... B65D 83/38 222/95
2008/0006719 A1 * 1/2008 Clerget ..... B05B 1/14 239/337
2008/0105713 A1 * 5/2008 Fahy ..... B05B 11/0018 222/382
2008/0164286 A1 * 7/2008 Garcia ..... B05B 11/0013 222/321.7
2008/0197149 A1 * 8/2008 Law ..... B05B 11/3001 222/153.13
2009/0179032 A1 * 7/2009 Livingston ..... B65D 41/325 220/254.7
2011/0315712 A1 * 12/2011 Chiba ..... B05B 11/3001 222/137
2012/0061344 A1 * 3/2012 Hutchinson ..... B29C 44/04 215/382
2012/0160867 A1 * 6/2012 Goodman ..... A61B 17/00491 222/1
2012/0205401 A1 * 8/2012 Litten ..... A45D 34/02 222/252
2012/0234872 A1 * 9/2012 Good ..... B05B 11/3047 222/382
2012/0248127 A1 * 10/2012 Wurster ..... B65D 41/045 220/721
2013/0209797 A1 * 8/2013 Gkinosatis ..... B32B 5/00 428/340
2013/0221035 A1 * 8/2013 Fourment ..... B05B 11/3094 222/402.2
2014/0263342 A1 * 9/2014 Gillespie ..... B32B 27/08 220/359.3
2015/0083727 A1 * 3/2015 Smolko ..... B65D 23/12 220/373
2015/0083757 A1 * 3/2015 Muller ..... B05B 11/0037 222/321.7
2015/0367614 A1 * 12/2015 Sasaki ..... C09D 143/02 428/522
2016/0152013 A1 * 6/2016 Gillespie ..... B32B 27/08 220/359.3
2017/0246649 A1 * 8/2017 Elmeguenni ..... A45D 34/00
2017/0283133 A1 * 10/2017 Schulz ..... B29C 49/20
2018/0155114 A1 * 6/2018 Schulz ..... B65D 83/0055

FOREIGN PATENT DOCUMENTS

FR 3008901 A1 1/2015
WO 00/41951 A1 7/2000
WO 2007/107174 A1 9/2007

* cited by examiner

PRODUCT DISPENSING SYSTEM FOR A BOTTLE

CROSS-REFERENCE TO RELATED APPLICATIONS

This application claims priority to French application Serial No. 1651678 filed Feb. 29, 2016, which application is incorporated by reference in its entirety.

FIELD

The invention relates to the field of bottle dispensing systems, in particular bottles comprising a withdrawal tube to allow a withdrawal member to be supplied with product.

BACKGROUND

The bottles used in perfumery, cosmetics or the pharmaceutical industry that contain a product of the liquid, gel or cream type may comprise a dispensing system comprising a withdrawal member in order to retrieve the contents of said bottle in the form of a stream or an aerosol made up of fine droplets. To that end, the withdrawal member withdraws the product from the bottle through a submerged withdrawal tube, and pushes it under pressure to the inside of a conduit arranged in an actuating piece of the withdrawal member.

For technical and/or aesthetic reasons, the withdrawal member and/or the actuating piece are often at least partially covered by a rigid ring, for example made from aluminum.

It is necessary for the different parts of the dispensing system, in particular the dispensing tube and the rigid rings, to be solidly fastened against the element that supports them such as the withdrawal member, the actuating part or a fastening part of the system on the bottle.

One known technique for maintaining the different parts is maintaining by gripping. However, these parts, such as the withdrawal tube, the body of the withdrawal member, the actuating part and the fastening part, are generally made with a base of a polymer that ages and relaxes with time, and mechanical maintenance by simple gripping is no longer sufficient to keep them together.

It is also possible to maintain these different parts by snapping. However, this method requires producing reliefs on the surface of the parts, which makes the manufacturing thereof more complicated and more expensive.

There is therefore a need for a dispensing system for a bottle comprising a withdrawal tube and a withdrawal member that is easy to design and in which the various parts are kept together effectively, in particular over the long term.

SUMMARY OF SELECTED ASPECTS

To that end, the present invention proposes a dispensing system suitable for being fastened on a bottle, said system comprising parts facing one another having surfaces facing one another, said system comprising a material allowing at least part of at least one of said surfaces facing one another to have an adhesive effect for attaching said facing parts.

An adhesive effect refers to procuring an adhesion power on the surface. The term "tack" is often used, which is the sticky nature of a material. In other words, an adhesive effect makes it possible to adhere two elements to one another, here two facing surfaces, in particular by the ability of one of the two to adhere in contact with the second, such that there is holding by friction/rubbing between the two facing parts. This solution is quite different from a glue or an adhesive containing more or less hard glue and that is distributed on the two facing surfaces.

The use of such a material makes it possible to improve and/or adjust the adherence between the facing parts. In other words, once the parts are assembled, they are kept together due simply to their contact and due to the considerable holding by friction/rubbing between the two parts owing to the adhesive effect of at least one of the facing surfaces, then preventing any relative movement of one part with respect to the other. In this way, even if the polymer used in the part(s) in question ages and relaxes, the attachment of said parts remains effective owing to this holding by friction/rubbing. The various parts are thus kept together over the long term.

According to different embodiments of the invention, which may be considered together or separately:

- said adhesive effect is present over the entire surface of one of or said facing parts,
- said adhesive effect is present over a zone of the surface of one of or said facing parts,
- said zone(s) are one or several points, one or several rings, one or several strips,
- said material comprises an adhesive agent,
- the adhesive agent is comprised in the mass of the or said facing parts,
- the adhesive agent is comprised in an outer layer of the or said facing parts,
- the adhesive agent is comprised in a coating of the or said facing parts,
- the adhesive agent is chosen from among poly-isobutylene (PIB), atactic polypropylene (APP), a polymer having a density lower than 0.9 g/cm$^3$, such as a plastomer, a thermoplastic elastomer, a thermoplastic polyolefin (TPO), or a mixture thereof,
- the or said facing parts comprise a matrix,
- said matrix is a polymer,
- said polymer is a polyolefin,
- said polyolefin is polyethylene, such as linear low-density polyethylene (LLDPE),
- the quantity of masterbatch is less than 80 wt % of said material,
- preferably, the quantity of masterbatch is comprised between 10 and 40 wt % of said material, still more preferably between 10 and 20 wt % of said material, between 20 and 40 wt % of said material,
- said facing parts are:
  - a withdrawal member and a withdrawal tube of said system,
  - an actuating part and a first decorative part of said system, and/or
  - a fastening part and a second decorative part of said system.

The invention also relates to a bottle comprising a dispensing system as previously defined.

BRIEF DESCRIPTION OF THE DRAWINGS

Other features, aims and advantages of the invention will emerge from the following description, given purely as an illustration and non-limitingly, and which must be read in light of the appended figures, in which.

DETAILED DESCRIPTION OF EXEMPLARY EMBODIMENTS

Figure 1:
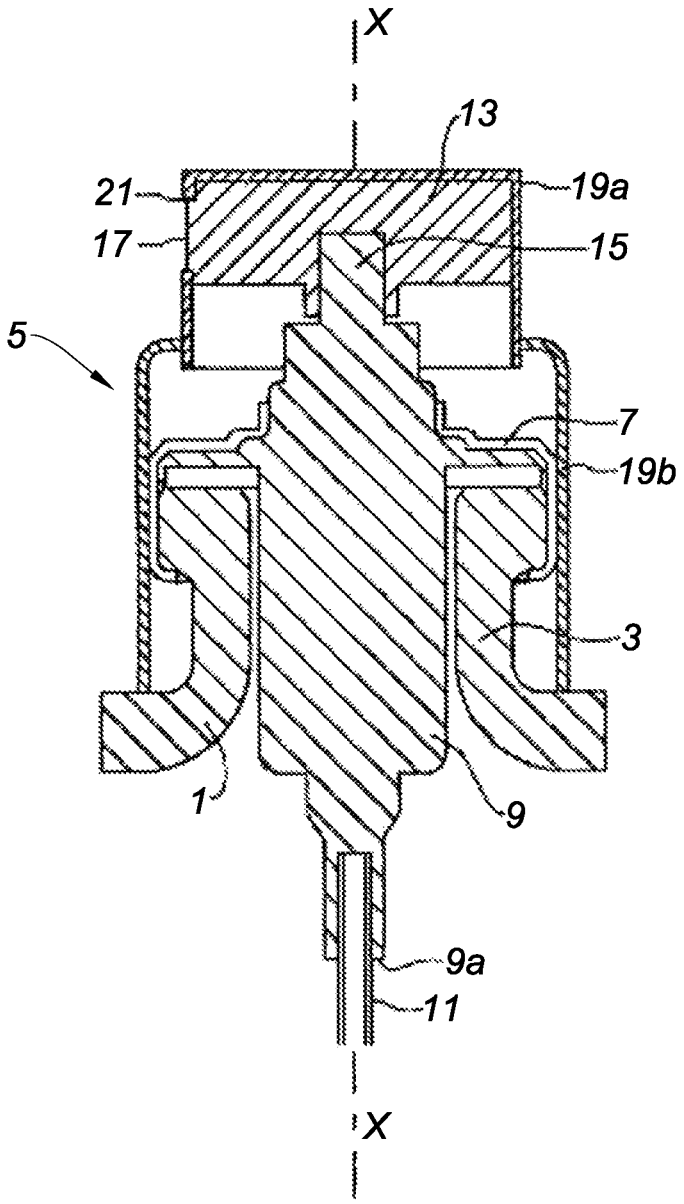
FIG. 1 is a partial longitudinal sectional view showing the assembly of a dispensing system comprising a withdrawal member on a bottle according to a first example.

In the description, the spatial positioning terms are given in reference to the position of the bottle 1 shown in FIG. 1.

A bottle 1 is described in which a product is intended to be packaged in relation to FIG. 1. The product may in particular be of the liquid, gel or cream type for use for example in perfumery, cosmetics or pharmaceuticals.

The bottle 1 is provided with an opening 3 on which a product dispensing system 5 is fastened.

FIG. 1 shows a fastening of the dispensing system 5 on the outside of the opening 3 using a fastening part 7, the invention not being limited to this particular embodiment.

The dispensing system 5 comprises a withdrawal member 9 and a withdrawal tube 11 (also called plunger tube) communicating with one another.

The withdrawal member 9 can be a pressurized withdrawal member, such as a pump, or a valve. In the illustrated embodiment, the withdrawal member 9 is a pump.

Said pump is mounted on said fastening part 7 such that it is in tight communication with the product packaged in the bottle 1.

Said withdrawal tube 11 is mounted on the withdrawal member 9 in the lower part via an associating part 9*a*. The withdrawal tube 11 is submerged in the product to allow said withdrawal member 9 to be supplied with product to be dispensed.

The withdrawal member 9 and the associating part 9*a* incorporate functional members (not shown) that make it possible, by actuating an actuating part 13 (also called pushbutton), to dispense the product via a spray nozzle 15 and a tip (not shown) situated at an outlet orifice 17 of said actuating part 13.

A large number of arrangements and pump kinematics exist that allow a product to be dispensed, on which the dispensing system 5 according to the invention can be implemented.

Advantageously, said withdrawal member 9 and/or said withdrawal tube 11 are made from a polymer chosen from among polypropylene, polyethylene, poly-butylene terephthalate or a mixture thereof.

Advantageously, said actuating part 13 and/or said fastening part 7 are made from a polymer, for example a polyolefin such as polypropylene or polyethylene, or a mixture thereof.

Said dispensing system 5 may also comprise at least one decorative part. Said decorative part(s) make it possible to conceal the parts of the system and improve the aesthetics of the bottle 1.

In particular, as shown in FIG. 1, said system may comprise a first decorative part 19*a* suitable for being fastened on said actuating part 13. Said first decorative part 19*a* advantageously has a symmetrical shape, in particular cylindrical, relative to a longitudinal axis X-X. Here, it assumes the form of a cylindrical enclosure surrounding said actuating part 13. Preferably, said first decorative part 19*a* has an opening 21 allowing the product to be dispensed through said tip and corresponding to the outlet orifice 17 of said actuating part 13.

Said dispensing system 5 can also comprise a second decorative part 19*b* suitable for being fastened on said fastening part 7 of said dispensing system 5 on the bottle 1. Said second decorative part 19*b* generally has a symmetrical shape, in particular cylindrical, relative to the longitudinal axis X-X. In the case at hand, it is a cylindrical ring.

It is also possible to consider said first and second decorative parts 19*a*, 19*b* having a frustoconical shape or any other shape making it possible to conceal part of said dispensing system 5 in an aesthetically pleasing manner, in particular the actuating part 13 and/or the fastening part 7.

Preferably, said first and second decorative parts 19*a*, 19*b* can be made from a substantially rigid material, for example, a metal such as aluminum, or a rigid polymer.

Thus, said dispensing system 5 comprises facing parts having facing surfaces. In order to ensure the attachment said facing parts, said system comprises a material making it possible for at least a portion of at least one of said facing surfaces to have an adhesive effect.

In the embodiment shown here, said facing parts are:

- the withdrawal member 9 and the withdrawal tube 11 of said system, in particular at the associating part 9*a* of said withdrawal member 9,
- said actuating part 13 and said first decorative part 19*a*, and/or
- said fastening part 7 and said second decorative part 19*b*.

In a first embodiment, the adhesive effect is present over the entire surface of one of or said facing parts.

In a second embodiment, the adhesive effect is present over a zone of the surface of one of or said facing parts. Said zone(s) may be one or several points, one or several rings, one or several strips. The adhesive effect can be distributed regularly or irregularly over at least one of said facing surfaces.

Irrespective of the embodiment, advantageously, said material comprises an adhesive agent.

In one particular embodiment, the adhesive agent is comprised in the mass of the or said facing parts. In this case, the entire volume of the part is affected by the addition of this adhesive agent.

In another specific embodiment, the or said facing parts are made from a multilayer material. The adhesive agent is then preferably comprised in an outer layer of the or said facing parts, in contact with a second facing part.

In yet another specific embodiment, the adhesive agent is comprised in a coating of the or said facing parts. Advantageously, the coating is applied after the manufacturing of the or said facing parts.

In all of these embodiments, advantageously, the adhesive agent is chosen from among poly-isobutylene (PIB), atactic polypropylene (APP), a polymer having a density lower than 0.9 g/cm$^3$, such as a plastomer, a thermoplastic elastomer, a thermoplastic polyolefin (TPO), or a mixture thereof, PIB is known for having substantial adhesive properties, but can be difficult to manipulate. Conversely, APP has lower adhesive properties, but provides user comfort, in particular due to its lower noise during unwinding.

The plastomer with a density below 0.9 g/cm$^3$ can in particular be a copolymer of ethylene and oct-1-ene obtained by metallocene catalysis such as Queo 2M139®, Queo 0207LA® or Queo 8207LA® sold by the company Borealis.

The thermoplastic elastomer with a density below 0.9 g/cm$^3$ can in particular be a styrenic thermoplastic elastomer (TPE-S), a vulcanized olefinic thermoplastic elastomer (TPE-V), a polyurethane thermoplastic elastomer (TPE-U), a copolyester thermoplastic elastomer (TPE-E), a copolyamide thermoplastic elastomer (TPE-A).

The elastomer with a density below 0.9 g/1 cm$^3$ can in particular be a polymer having elastic properties, obtained after cross-linking, i.e., with natural (NR) or synthetic (or artificial/SBR) macromolecular substances.

The polyolefinic thermoplastic with a density below 0.9 g/cm$^3$ can be an olefinic thermoplastic elastomer.

It has been observed that using adhesive agents makes it possible not only to improve the adhesion of the facing parts, but also advantageously to decrease the stiffness of the parts and increase the plasticizing of the material. The assembly effort of the parts is thus decreased and makes the dispensing system easier to manufacture. The modification of the properties of the material also causes improved aging of the polymer, and the assembly remains even more effective over the long term.

Advantageously, the or said facing parts comprise a matrix.

Advantageously, the adhesive agent is in mixture in said matrix, which in particular makes it possible to facilitate manipulation of the adhesive agent. The matrix/adhesive agent mixture is commonly called masterbatch. This masterbatch is completely different from an adhesive or glue as used in the prior art.

Said matrix is generally a polymer, such as a polyolefin, a polyester, or polyamide. This may be polyethylene (PE), in particular a linear low-density polyethylene (LLDPE).

The use of a polyethylene-based matrix, in particular LLDPE, makes it possible to improve the properties of the part, in particular at the facing part, comprising said material. The latter is thus more flexible, which makes it easier to assemble on a second part.

This may thus involve commercial masterbatches, such as:

- PW52®, PW60®, PW66® or PW70® sold by the company Polytechs, and manufactured with a base of a PIB adhesive agent in a LLDPE matrix;
- PX004V® sold by the company Polytechs, and manufactured with a base of an APP adhesive agent in a LLDPE matrix.

Advantageously, in the facing part(s) having the adhesive effect, the masterbatch is associated with a "base material" at an optimized concentration, to manufacture the part(s).

For a part having an adhesive effect, the material chosen for the matrix of the masterbatch must belong to the same chemical family as the base material of the part. The table below gives examples for a part having an adhesive effect:

| Base material | Matrix of the masterbatch |
|---|---|
| Polybutylene terephthalate (PBT) | Polyester |
| Polypropylene (PP) | Polyolefin |
| Polyamide 6.6 (PA 6.6) | Polyamide (PA) |

In all of these cases, it is necessary to have the same type of polymer (family) in the base material of the part and in the associated masterbatch, so that the technical effect of the attachment is optimal.

Advantageously, the quantity of masterbatch is less than 80 wt % of said material. In other words, the zone(s) having an adhesive effect comprise a maximum of 80 wt % of masterbatch relative to their component material.

Preferably, the quantity of masterbatch is comprised between 10 and 40 wt % of said material, still more preferably between 10 and 20 wt % of said material or between 20 and 40 wt % of said material.

For example, the PW60® masterbatch is mixed with a content level of 15% in a part whose base material is polypropylene (PP).

Advantageously, the quantity of adhesive agent depends on the desired adhesive effect, i.e., the adhesion power that the user wishes to obtain between the facing parts. The quantity of adhesive agent also varies based on the section of the zone having an adhesive effect and/or the type of the facing surfaces. Thus, the adhesive effect desired by the user can be different, depending on whether the facing part for example has a polymer surface or a metal surface, or whether the adhesive effect is present on all or part of the facing surface.

It has thus been observed that:

- for a quantity of masterbatch comprised between 10 and 20 wt % of said material, a medium assembly force and quick plasticizing of the material after deformation are obtained,
- for a quantity of masterbatch comprised between 20 and 40 wt % of said material, a low assembly force and lesser plasticizing of the material after deformation are obtained, while retaining significant frictional holding in both cases, and therefore significant attachment of the facing parts as of their assembly and also after aging.

To observe this, tests are done to determine the optimal concentration of masterbatch in the base material.

Tests for a quantity of masterbatch (PW60®) of 10 wt %, 15 wt %, 20 wt % and 30 wt % of the material:

- inject the parts with a given percentage of masterbatch (PW60®) in turn containing the adhesive agent (PIB), in the base material (PP), like a dye, talc or gliding additive;
- assemble the facing parts;
- perform temperature-accelerated aging;
- measure the holding of the parts through normalized tests: measure the holding force by rubbing (or friction) in Newton, i.e., the force at which the parts detach.

These normalized tests consist of using a traction/compression machine with a stationary lower part in which the pump is embedded and an upper part that grips the decorative part with a clamp and pulls on it with a given load.

Results: The best compromise between the manufacturing process (injection and assembly) and mechanical holding after aging was found between 15 wt % and 20 wt % of masterbatch (PW60®) of the material.

The second part, facing the first part containing the adhesive agent, can be manufactured from a different base material or a base material equivalent to that of the first part.

The second part can be made from aluminum or plastic, and may or may not be filled with an adhesive agent.

Here are a few examples:

- First part made from PP filled at 15 wt % with PW60® masterbatch, with a second part made from aluminum;
- First part made from PP filled at 15 wt % with PW60® masterbatch, with a second part made from non-filled PP;
- First part made from PP filled at 15 wt % with PW60® masterbatch, with a second part made from PP filled at 15 wt % with PW60® masterbatch;
- First part made from PP filled at 15 wt % with PW60® masterbatch, with a second part made from non-filled PBT;
- First part made from PP filled at 15 wt % with PW60® masterbatch, with a second part made from PBT filled at between 15 wt % and 30 wt % with masterbatch.

Figure 2:
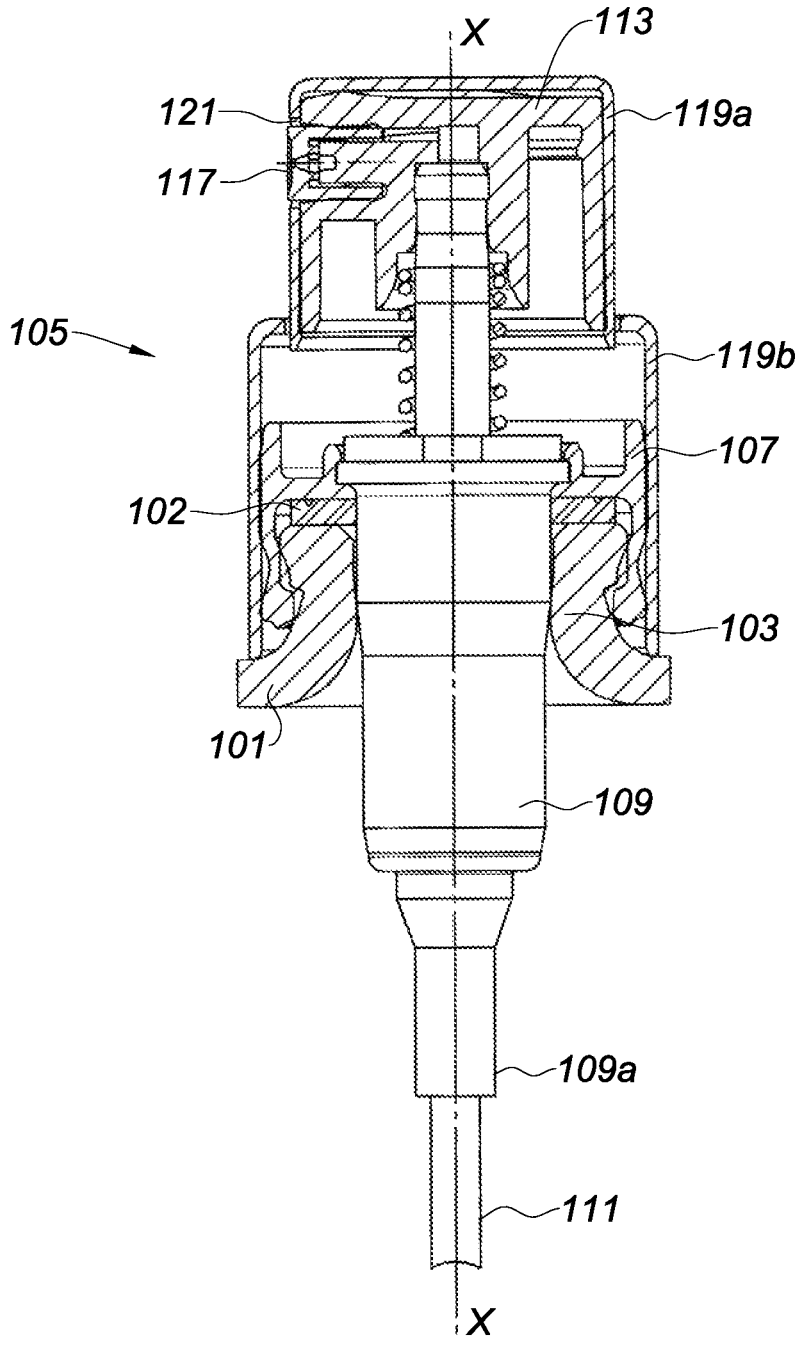
FIG. 2 is a partial longitudinal sectional view showing the assembly of a dispensing system comprising a withdrawal member on a bottle according to a second example.

FIG. 2 shows another example embodiment of the invention. This example uses a structure similar to the first example, and the elements having similar functions are designated using the same references, adding the digit 1 in the hundreds place. For instance, dispensing system 105 is provided on bottle 101 having opening 103.

EXAMPLE

Part 7 FIG. 1 and Part 107 FIG. 2

The fastening part 107 has a different shape from the fastening part 7, but performs the same function. In particular, the part 107 has an upper peripheral skirt and a lower peripheral skirt, these parts performing the same function as the annular peripheral wall of the part 7.

In this FIG. 2, the facing parts are:

the withdrawal member 109 and the withdrawal tube 111 of said system, in particular at the associating part 109*a* of said withdrawal member 109, said actuating part 113 and said first decorative part 119*a*, preferably, said first decorative part 119*a* has an opening 211 allowing the product to be dispensed through said tip and corresponding to the outlet orifice 117 of said actuating part 113. and/or said fastening part 107 and said second decorative part 119*b*.

Preferably, the adhesive agent is comprised in the mass of the or said facing parts. An adhesive effect is produced, i.e., holding by friction/rubbing between the two facing parts when they are placed in contact.

There is no glue that spreads hot or cold. There is only at least one part that comprises at least one zone that comes into contact with the other part, and that holds it by friction, owing to the material from which it is made. This holding by friction makes it possible to increase the mechanical force between the two parts, and therefore to better attach them, and avoid any sliding between them.

When the two parts are attached, sealing is not necessarily guaranteed between them. Indeed, the adhesive material is different from a sealing gasket, the function of which is to seal the junction between two parts and not to attach the parts to one another.

In FIG. 2, the sealing function of the dispensing system is performed by a seal 102.

As one preferential example, the first fastening part 107 is made up of:

between 8 and 30 wt % of PW60® masterbatch formed by a PIB adhesive agent with a PE matrix, for the difference, a PP-based material.

More specifically, 15 wt % of the fastening part 107 is made up of PW60®, and 85 wt % is made up of base material.

The second decorative part 119*b* is made up of polypropylene without masterbatch, and therefore without adhesive agent.

The invention claimed is:

1. A dispensing system suitable for being fastened on a bottle, said system comprising elements facing one another having surfaces contacting one another and oriented parallel to a central axis of the dispensing system, wherein at least one element comprises a material allowing at least part of at least one of said surfaces contacting one another to have an adhesive effect for attaching said elements facing one another such that there is holding by friction and/or rubbing between said elements facing one another, wherein said material comprises 1) a base material comprising a first polymer, and 2) a mixture of an adhesive agent and a matrix comprising a second polymer;

wherein the adhesive agent is poly-isobutylene (PIB);

wherein the matrix is polyethylene;

wherein the mixture forms a masterbatch and said material comprises between 8 and 30 wt % of said masterbatch;

wherein the base material is polypropylene;

wherein the material is comprised in a mass forming at least one of said elements facing one another;

wherein said elements facing one another include at least one set selected from the group consisting of:

a withdrawal member and a withdrawal tube, an actuating part and a first decorative part, and a fastening part and a second decorative part.

2. The dispensing system according to claim 1, wherein said adhesive effect is present over an entire surface of at least one of said surfaces contacting one another.

3. The dispensing system according to claim 1, wherein said adhesive effect is present over a zone of at least one of said surfaces contacting one another.

4. The dispensing system according to claim 3, wherein said zone is one or several points, one or several rings, one or several strips.

5. A bottle comprising the dispensing system according to claim 1.

6. The dispensing system according to claim 1, wherein the mixture is injected into a mold.

7. The dispensing system according to claim 1, wherein said parts facing one another include the withdrawal member and the withdrawal tube.

8. The dispensing system according to claim 1, wherein said parts facing one another include the actuator and the decorative part.

9. The dispensing system according to claim 1, wherein the material comprises 15 wt % of the masterbatch.

10. A dispensing system suitable for being fastened on a bottle, said system comprising elements facing one another having surfaces contacting one another and oriented parallel to a central axis of the dispensing system, wherein at least one element comprises a material allowing at least part of at least one of said surfaces contacting one another to have an adhesive effect for attaching said elements facing one another such that there is holding by friction and/or rubbing between said elements facing one another, wherein said material comprises 1) a base material and 2) a mixture of an adhesive agent and a matrix, wherein:

the base material is selected from the group consisting of polybutylene terephthalate, polypropylene, and polyamide 6.6, the adhesive agent is selected from the group consisting of poly-isobutylene (PIB), atactic polypropylene (APP), a polymer having a density lower than 0.9 g/cm$^3$, mixtures thereof, the matrix is selected from the group consisting of polyester, polyolefin, and polyamide, wherein the material is comprised in a mass forming at least one of said elements facing one another;

wherein said elements facing one another include at least one set selected from the group consisting of:

a withdrawal member and a withdrawal tube, an actuating part and a first decorative part of, and a fastening part and a second decorative part.

11. The dispensing system according to claim 10, wherein said adhesive effect is present over an entire surface of at least one of said surfaces facing one another.

12. The dispensing system according to claim 10, wherein said adhesive effect is present over a zone of at least one of said surfaces contacting one another.

13. The dispensing system according to claim 10, wherein the mixture forms a masterbatch and said material comprises less than 80 wt % of said masterbatch.

14. A bottle comprising the dispensing system according to claim 10.

15. The dispensing system of claim 13, wherein the adhesive agent is PIB; the matrix is polyethylene, and the base material is polypropylene; and wherein the material comprises between 8 and 30 wt % of said masterbach.

16. The dispensing system according to claim 15, wherein the material comprises 15 wt % of the masterbach.

* * * * *